United States Patent [19]

Sahashi et al.

[11] Patent Number: 4,985,072

[45] Date of Patent: Jan. 15, 1991

[54] POLYCRYSTALLINE MAGNETIC SUBSTANCES FOR MAGNETIC REFRIGERATION AND A METHOD OF MANUFACTURING THE SAME

[75] Inventors: Masashi Sahashi, Yokohama; Hiromi Niu, Tokyo; Koichiro Inomata, Yokohama, all of Japan

[73] Assignee: Kabushiki Kaisha Toshiba, Kanagawa, Japan

[21] Appl. No.: 248,286

[22] Filed: Sep. 22, 1988

Related U.S. Application Data

[63] Continuation of Ser. No. 912,505, Sep. 29, 1986, abandoned.

[30] Foreign Application Priority Data

Sep. 30, 1985 [JP] Japan ..... 60-214617
Apr. 15, 1986 [JP] Japan ..... 61-86611

[51] Int. Cl.[5] ..... B22F 9/00; C22C 5/00

[52] U.S. Cl. ..... 75/246; 75/249; 252/62.55; 419/23; 419/38; 419/66

[58] Field of Search ..... 252/62.55; 75/246, 249; 419/23, 38, 66

[56] References Cited

U.S. PATENT DOCUMENTS 3,447,912 6/1969 Ortner et al. ..... 75/245
3,560,200 2/1971 Nesbitt et al. ..... 420/416
3,856,580 12/1974 Sneggil et al. ..... 148/105
3,892,600 7/1975 Smeggil et al. ..... 428/570
4,849,017 7/1989 Sahashi et al. ..... 75/245

FOREIGN PATENT DOCUMENTS 55-99703 7/1980 Japan ..... 252/62.55
57-16101 1/1982 Japan ..... 252/62.55
57-95607 6/1982 Japan ..... 252/62.55
59-35647 2/1984 Japan ..... 252/62.55
61-91336 5/1986 Japan ..... 75/245

*Primary Examiner*—Stephen J. Lechert, Jr.
*Assistant Examiner*—Leon Nigohosian, Jr.
*Attorney, Agent, or Firm*—Foley & Lardner, Schwartz, Jeffery, Schwaab, Mack, Blumenthal & Evans

[57] ABSTRACT

The polycrystalline magnetic substance for magnetic refrigeration in or gas refrigeration accordance with the present invention comprises a plurality of magnetic alloy fine crystalline powders that include at least one kind of rare-earth element selected from the group of Y, La, Ce, Pr, Nd, Pm, Sm, Eu, Gd, Tb, Dy, Ho, Er, Tm, and Yb, with the remainder metal consisting substantially of 2 kinds selected from Al, Ni, Co, and Fe, and a metallic binder which forms a compact together with the fine crystalline particles, where the abundance ratio of the metallic binder in the compact is 1 to 80% by volume.

22 Claims, 15 Drawing Sheets

ErNi3+Ni(-Er)+Ni-Au
DyNi3+Ni(-Dg)+Ni-Au

Au

POLYCRYSTALLINE MAGNETIC SUBSTANCES FOR MAGNETIC REFRIGERATION AND A METHOD OF MANUFACTURING THE SAME

This application is a continuation of application Ser. No. 912,505, filed Sept. 29, 1986, now abandoned.

BACKGROUND OF THE INVENTION

1. Field of the Invention

The present invention relates to polycrystalline magnetic substances for magnetic refrigeration for carrying out cooling by the use of magneto-caloric effect, and a method of manufacturing the same, and more specifically to polycrystalline magnetic substances for magnetic refrigeration with an excellent heat conduction property which is capable of producing a sufficient cooling effect over a wide range of refrigeration temperature region, and a method of manufacturing the same.

2. Description of the Prior Art

Accompanying the remarkable advancement in the superconduction technology which has taken place in recent years, industrial electronics is being contemplated for its application to a wide range of fields such as information industry and medical apparatus. In order to employ superconduction technology, it is indispensable to develop a refrigeration method. However, this method has a very low efficiency, and moreover, the facility required becomes large in size so that research on the magnetic refrigeration method that makes use of the magneto-caloric effect of magnetic substances has been going on vigorously as an alternative new refrigeration method (see, for example, Proceedings of ICEC 9 (May, 1982), pp. 26–29 and Nakagome ex al, in Advances in Cryogenic Engineering, 1984, Vol. 29, pp. 581–587). Nakagome et al describes a new magnetic refrigeration process for liquefying helium from the temperature of 20K, using gadolinium-gallium-garnet (GGG) for the magnetic material. The refrigerator for such a process consists of (1) a magnetic material (GGG single crystal), (2) a heat expelling portion (20K gaseous helium flow line), (3) a low temperature portion at 4.2K (liquid helium bath), (4) a heat pipe as a thermal switch, and (5) a superconducting pulsed magnet.

Nakagome's magnetic refrigeration process operates on the following principle (a) when the magnetic material is placed in a high-intensity magnetic field generated by the pulsed magnet, the temperature of the GGG rises to over 20K, (b) the temperature of the GGG is then lowered by removing heat from the GGG by flowing 20K gaseous helium over its surface, (c) after removal of heat, the magnetic field is eliminated and the temperature of GGG goes below 4.2K, and (d) the GGG then absorbs heat from liquid helium bath through the heat pipe which functions as a thermal switch on the low temperature side.

The basic principle of the magnetic refrigeration method is to utilize the endothermic and exothermic reactions due to the change ($\Delta S_M$) in entropies for the spin arrangement state which is obtained by applying a magnetic field to a magnetic substance and for the state of irregular spins that is obtained when the magnetic field is removed. Since the larger the $\Delta S_M$, the larger is the cooling effect obtained, various kinds of magnetic substances are being investigated.

As may be clear from FIG. 1 which shows the relationship between the temperature and $\Delta S_M$ for a magnetic substance, $\Delta S_M$ temperature (magnetic transition point) and decreases for the temperatures above and below that point. It means then that a sufficient cooling effect can be obtained for only a delicate temperature range which is in the neighborhood of the magnetic transition point for such a magnetic substance.

In order to resolve the above problem, one only needs to adopt a magnetic substance that possesses a plurality of different magnetic transition points. As a result, it will become possible to obtain a sufficient cooling effect over a relatively wide range of temperature region.

As materials that can form magnetic substances that possess a plurality of magnetic transition points, there are known $RA1_2$ Laves type intermetallic compounds (R signifies a rare-earth element) and others (see Proceedings of ICEC 9 (May, 1982) pp. 30–33 and others).

In other words, by mixing powders of two kinds or more of such compounds and sintering the mixture, it is considered that a magnetic substance that possesses a plurality of magnetic transition points can be obtained. However, in a magnetic substance that is obtained by above method, mutual diffusion proceeds during sintering among the powders of different kinds of compound, and as a result, $\Delta S_M$ will become to have just one maximum.

In addition to the $RA1_2$ Laves type intermetallic compounds, there are known garnet-based oxide single crystals represent by $Gd_3Ga_5O_{12}$ and $Dy_3Al_5O_{12}$ that include rare-earth elements. However, it is known that a sufficient cooling effect can be obtained only for the temperature region below 4K in these materials. Accordingly, such substances cannot respond to the demand for polycrystalline magnetic substances which can provide a sufficient effect over a wide ranges of temperature region above 4K.

For instance, in Japanese Patent Publication No. 60-204852, there are disclosed porous magnetic substances obtained by sintering the mixture of three kinds or more of magnetic substances with different Curie temperatures.

However, the magnetic substances described in the above publication are porus sintered bodies so that their heat conductivity is poor and hence it is difficult to effectively utilize the magneto-caloric effect that has advantages as described above.

On the other hand, if a magnetic substance is sintered by compacting it under high pressure in an attempt to obtain a magnetic substance with high filling factor for the powder of the magnetic substance, there is formed a homogeneous solid solution, so that such a substance has a disadvantage in that it is not possible to obtain a large entropy change over a wide range of temperature region.

SUMMARY OF THE INVENTION

The object of the present invention is to provide polycrystalline magnetic substances for magnetic refrigeration, and a method of manufacturing the same, which are capable of giving a sufficient cooling effect over a wide range of refrigeration temperature region, and yet, have an excellent heat conducting property.

A feature of the present invention is to form, as a polycrystalline magnetic substance for magnetic refrigeration, a compact that consists of powders of a magnetic alloy that includes at least one kind of element selected from among the group of Y, La, Ce, Pr, Nd, Pm, Sm, Eu, Gd, Tb, Dy, Ho, Er, Tm, and Yb, the remainder consisting substantially of at least one kind of element selected from the group of Al, Ni, and Co, and a metallic binder that consists of at least one kind of binder, wherein the abundance ratio of the metallic binder in the compact is set to the 1 to 80% by volume.

The method of manufacturing the polycrystalline magnetic substance for magnetic refrigeration is to form a metallic covering film by plating method or vapor phase growth method on the surface of the powders of a magnetic alloy that contains at least one element which is selected from among the group of Y, La, Ce, Pr, Nd, Pm, Sm, Eu, Gd, Tb, Dy, Ho, Er, Tm, and Yb, and the remainder substantially consisting of at least one element selected from the group of Al, Ni, and Co, then form a compact using the powder thus obtained.

As a result aof vigorous investingation, the inventors of the present invention were able to complete the invention by discovering the fact that a polycrystalline magnetic substance obtained by compacting the powders that are covered with a metallic binder described in the above of a magnetic alloy obtained in the above manner, has an excellent heat conduction property, and moreover that, in the case of polycrystallinge magnetic substance that consists of mixed powders containing a plurality of kinds of rare-earth elements, there does not occur mutual diffusion among powders of different kinds of magnetic alloy, and hence, becomes to possess a pluralilty of different magnetic transition points.

Another featrue of the present invention is that a polycrystalline magnetic substance is a mixed compact obtained from fine crystalline particles of two kinds or more of magnetic alloys that have different magnetic transition points, crystal phase transformation points, transformation points due to Jahn-Teller effect, or spin rearrangement temperatures, and that the filling factor is greater than 95%.

With such a mixture of polycrystalline magnetic substances, fine crystalline paritcles of two kinds or more of magnetic alloys are put into a united body under the condition of mutually independent separation. Since the magnetic transition point, crystal phase transformation point, transformation point due to Jahn-Teller effect, or spin rearrangement temperature is different for the fine crystalline particles of each magnetic alloy, it is possible to obtain a high magneto-caloric effect over a wide range of temperature. In addition, the filling factor is greater than 95% so that the heat conduction property of the plycrystalline magnetic substance is high and it can realize an excellent magneto-caloric effect in an effective manner. Here, the reason for setting the filling factor of the magnetic substance at a value above 95% is tha when the filling factor is below 95%, the heat conduction property is reduced so that even if the magneto-caloric effect is high, it becomes not possible to realize it effectively, making the magnetic subtance mechanically brittle.

Further, as fine crystal particles of two kinds or more of magnetic alloy to be used in the present invention, it is preferred to use those that contain at least one element selected from among Y, La, Ce, Pr, Nd, Pm, Sm, Eu, Gd, Tb, Dy, Ho, Er, Tm, and Yb, and at least one element selected from among B, Al, Ga, In, Tl, Si, Ge, Sn, Pb, Cu, Ag, Su, Be, Mg, An, Cd, Hg, Ru, Rh, Pd, Os, Ir, Pt, Fe, Co, and Ni.

Moreover, the method of manufacturing the mixture of polycrystalline substances in the above is to obtain a compact, by the impact pressure forming, of fine powders of two kinds or more of magnetic alloy that have different magnetic transition points, crystal phase transformation point, transformation points due to Jahn-Teller effect, or spin rearrangement temperatures.

These and other objects, features and advantages of the present invention will be more apparent from the following description of the preferred embodiments, taken in conjunction with the accompanying drawings.

BRIEF DESCRIPTION OF THE DRAWINGS

FIG. 24 is as diagram showing the configuration of the components in a device for magnetic refrigeration in accordance with the present invention; and FIG. 25 is a two-dimensional diagram of an alternative design of a device for magnetic refrigeration in accordance with the present invention.

DESCRIPTION OF THE PREFERRED EMBODIMENTS

Figure 1:
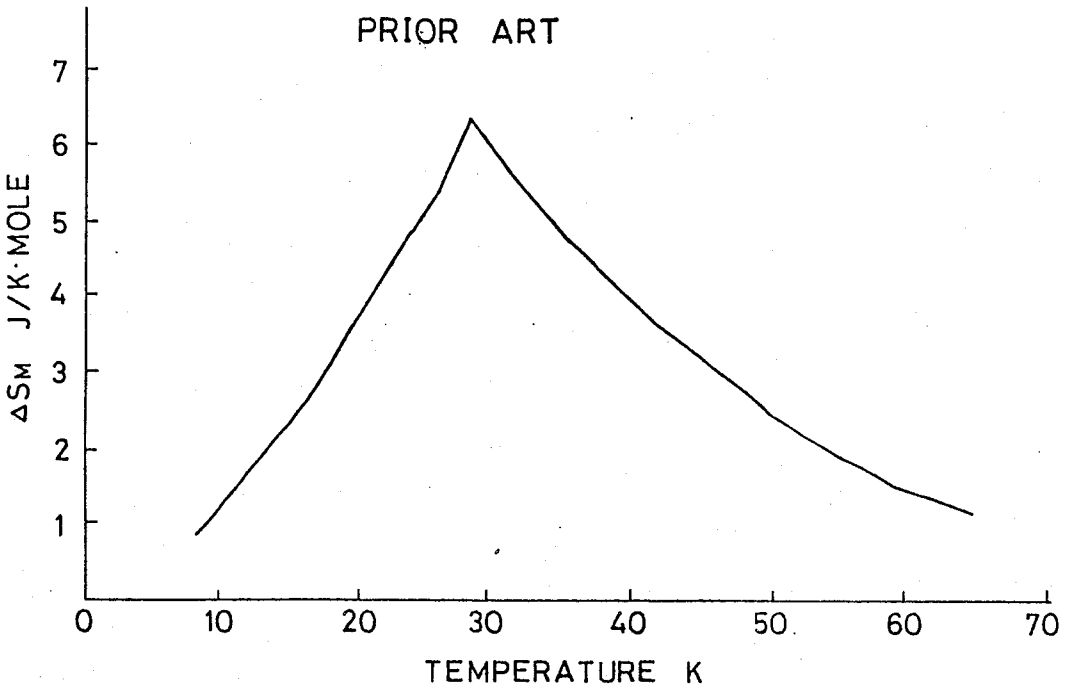
FIG. 1 PRIOR ART
FIG. 1 is a graph for showing the relationship between the temperature and the entropy change for a general magnetic substance.

The magnetic alloy powders for the first embodiment of the polycrystalline magnetic substance in accordance with the present invention is the powders of an alloy of the rare-earth-(Al, Co, Ni) type such as represented by $RAl_2$, $RNi_2$, and $RCo_2$, or magnetic alloy powders of its solid solution. Here, R signifies at least one kind of element selected from among the group of Y, La, Ce, Pr, Nd, Pm, Sm, Eu, Gd, Dy, Ho, Er, Tm, and Yb. In such alloy powders, it is preferred that the content of R (when R consists of more than two elements, the sum of their contents) be as will be described below. If the content does not reach the minimum value that will be shown below, $S_M$ fails to become large enough for any temperature below the room temperature so that sufficient refrigeration effect cannot be obtained. Preferably, the content of the remainder metal be more than 60% by weight for the case of Al, more than 20% by weight for Ni, and more than 40% by weight for Co. Further, the maximum content of the element R is preferred to be less than 99% by weight. The reason being that if the content exceeds 99% by weight, the pulverization property of the alloy is deteriorated markedly due to decrease in the content of Al, Ni, and Co, making the preparation of fine powders difficult because of the practical difficulty of obtaining a compact of the powders. Alloy powders which satisfy the conditions on the contents described above can be used as magnetic alloy powders for the present invention.

Alloy powders in the above can be manufactured in the following manner. Namely, for example, $RA1_2$, $RNi_2$, or $RCo_2$ alloy is obtained by melting in an arc fusing furnace. Next, alloy that is obtained in this way is pulverzied into fine powder. The particle diameter of this powder affects the filling factor in shaping this powder and the binder, that will be described later, into a compacted mold, so that it is desirable to have it 1 to 100 $\mu$m, preferably in the range of 2 to 30 $\mu$m. If the particle diameter exceeds 100 $\mu$m, the filling factor will be decreased, and if it is less than 1 $\mu$m, the particles tend to be oxidized so that desired refrigeration effect cannot be obtained.

Next, magnetic alloy powders obtained by the above method are prepared. In this case, although an excellent heat conduction property can be obtained by using powders of just one kink of alloy, if the compacting is carried out by using two kinds of more of alloy powders, then a polycrystalline magnetic substance with a plurality of magnetic transition points can also be obtained. When two kinds or more of alloy powders with different element R are prepared, the metal in the remainder of respective alloy powders may be either of the same kind or of different kinds. Thus, the powders to be prepared will be, for instance, the combination of $DyAl_2$, $ErAl_2$, $HoAl_2$, $DyHoAl_2$ or the combination of DyNi and $DyCo_2$. By mixing and compacting two kinds or more of alloy powders in this manner, it will be possible to obtain magnetic substances that possess more than two magnetic transition points.

Figure 2:
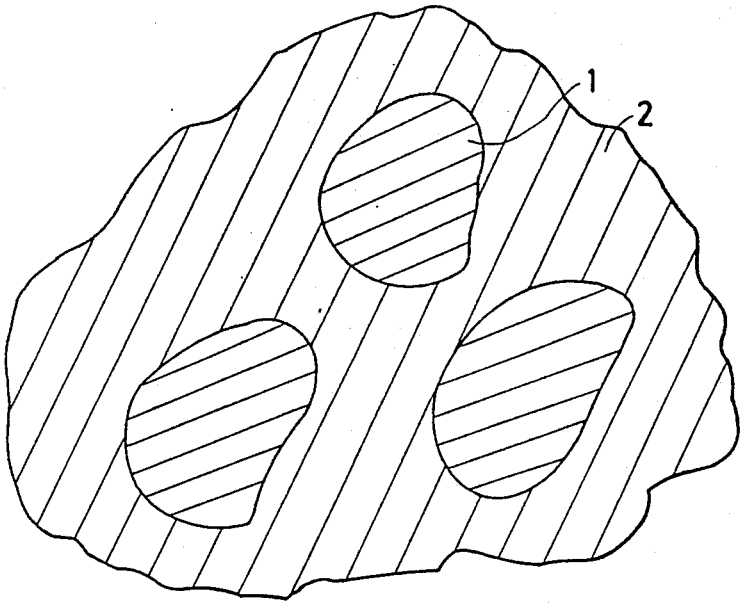
FIG. 2 is a schematic block diagram for a polycrystalline magnetic substance embodying the present invention.

The polycrystalline magnetic substance for a first embodiment consists of alloy powders 1 and a metallic binder 2 as shown in FIG. 2. The binder 2 acts to enhance the heat conduction property of the compact that can be obtained by a method to be described later, and also acts to bind the various kinds of mixed powders mentioned above, under a condition in which each powder is separated independent of the other. As a result, mutual diffusion among the powders is suppressed and a sintered body that possesses a plurality of magnetic transition points can be obtained.

As metals that can be used for the binder, one may mention metals such as Au, Ag, and Cu that have a satisfactory heat conduction property at low temperatures, or their alloys. However, any metal that possesses a heat conductivity of 1 W/cm.K or over at the temperature of 4.2K will be effective for enhancing the heat conduction property. Then, since the binder itself consists of a metal that possesses an excellent heat conduction property, the heat conduction property of the compact obtained will also be enhanced sharptly.

The abundance ratio of the binder in the compact is 1 to 80% by volume, and preferably 5 to 30% by volume. When the content is less than 1% by volume, the binding ability is small, making the compacting difficult, and in addition, mutual diffusion proceeds amoung the alloy powers during sintering which will be described later, making it difficult to achieve the object. Further, if it exceeds 80% by volume, the ratio of the magnetic alloy powers is reduced so that the refrigeration effect per unit volume is decreased, and moreover, because of the heating due to eddy current loss during controlling of the magnetic field, the refrigeration effect will be lowered markedly.

A compact that consists of a binder and alloy powders with the above abundance ratio can be manufactured in the following way.

First, the above alloy power is covered with a metal (binder) mentioned above. As the method of covering, one mention the plating method (for instance, the electroless plating method) or the vapor phase growth method such as the sputtering method. In applying the plating method, it is desirable to give a pre-treatment such as sensitizer treatment or activator treatment to the alloy powder.

In covering, it is desirable to ajust the amount of use of the covering metal so as to have a film thickness of 0.1 to 1 $\mu$m of the metal covering film for the particle diameter of 2 to 30 $\mu$m of the alloy powders. By setting the particle diameter and the film thickness to a predetermined relationship, it is possible to adjust the abundance ratio of the binder in the compact.

Next, alloy powders covered with the metal is formed into a desired compact, using a method of sintering after press forming or by the impact pressure forming method.

In the case of employing the sintering method, the pressure for pressing is set at 500 to 10,000 kg/cm$^2$, preferably 1,000 to 10,000 kg/cm$^2$. Then, the compact obtained is sintered in a nonoxidizing atmosphere. As a nonoxidizing atmosphere, use is made of a vacuum of below $10^{-6}$ Torr or an inert gas such as Ar and $N_2$.

The sintering temperature is set at 100° to 1,100° C., and preferably at 500° to 900° C. When a sintering temperature is below 100° C., it is not possible to obtain a high filling factor. On the other hand, when it exceeds 1,100° C., mutual diffusion proceeds between the binder metal and the alloy powders, obstructing the realization of a sufficient refrigeration effect over a wide range of temperature.

In the case of employing impact pressure forming method, the metal-covered magnetic alloy powder is filled in a capsule and it is formed into a high density compact by the shock pressuring. For this method, it is effective to apply, for instance, an impact pressure of 1 million to 10 million atm. press, by rail gun, impact pressure by rifle gun, explosive forming by the use of gun powder, and others. In addition, high pressure compacting with an ultra high pressure of 100,000 atm. press. is also effective.

EXAMPLE 1

An alloy (A) consisting of 75% by weight of Dy, and Al for the remainder and another alloy (B) consisting of 75.6% by weight of Er, and Al for the remainder were prepared separately by the user of the arc fusing furnace. By pulverizing each of these alloys into fine powders with particle diameter of about 30 μm by ball mill method, there were obtained powders of alloy (A) and alloy (B) which were mixed in a mixer with equal molar ratio to obtain a mixed powder.

After giving a sensitizer treatment (HCl-acid) and an activator treatment (HCl-acid) to the mixed powder obtained, a copper plating (NaOH-alkaline) was given by using TMP #500 A, B (chemical agents used are made by Okuno Pharmaceutical Industrial Company).

The ratio in weight of the alloy powder and the amount of copper plated was (from 3 to 4) to 1. By this plating treatment a covering film with thickness of 0.5 to 1 μm was formed on the surface of the alloy powders.

After the copper-plated alloy powders were press formed under a pressure of 10 t/cm$^2$, it was sintered at 600° C. in an atmosphere of Ar gas.

Figure 3:
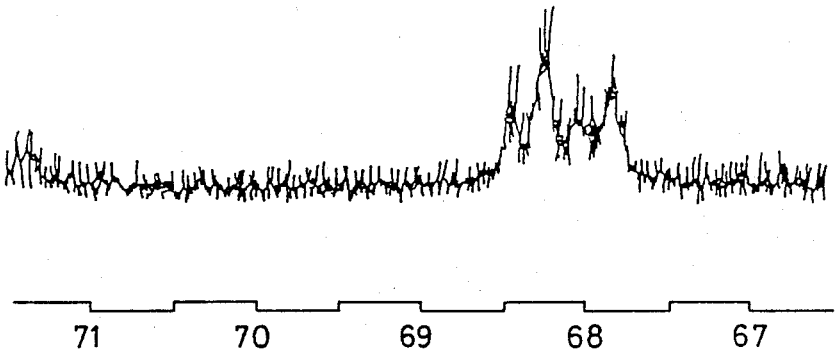
FIG. 3 is a graph for showing the result of X-ray diffraction measurement for Example 1 of the first embodiment shown in FIG. 2.

The result of X-ray diffraction measurement of the sintered body obtained is shown in FIG. 3.

Figure 4:
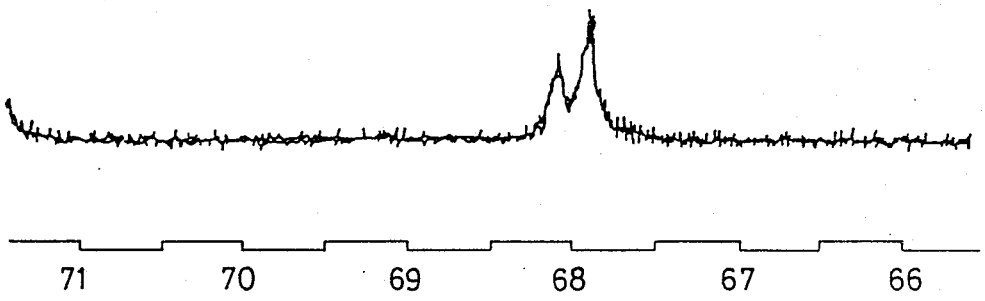
FIG. 4 is a graph for showing the result of X-ray diffraction measurement for Comparative Example 1 obtained by the conventional formation method of pressing.

Further, as Comparative Example 1, in FIG. 4 is shown the result of X-ray diffraction measurement on the sintered body that was obtained by press forming the mixed powders of the alloy (A) powders and alloy (B) powders without giving the plating treatment and sintering it at 1,100° C.

From the result of X-ray diffraction measurement for the (440) plane of the sintered body of Example 1, it was found that the lattice constant was a=7.793 for $ErAl_2$ and a=7.827 for $DyAl_2$. In contrast, the X-ray diffraction result for the (440) plane of Comparative Example 1 gave the value of a=7.817.

As may be seen clearly from FIGS. 3 and 4, for polycrystalline magnetic substance of Example 1, separate and independent presence of $ErAl_2$ and $DyAl_2$ can be confirmed by X-ray, whereas for Comparative Example 1, there is observed a progress of mutual diffusion as in evidenced by the decrease in the number of peaks in the graph.

Figure 5:
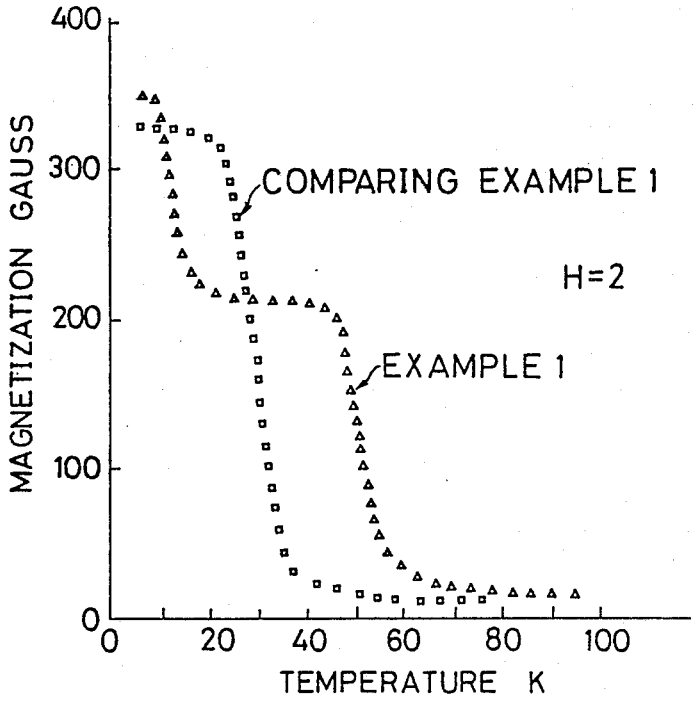
FIG. 5 is a graph for showing the result of magnetization measurement in a magnetic field with a flux density of 2 Tesla for Example 1 and Comparative Example 1 shown in FIG. 3 and FIG. 4, respectively.

In addition, the results of magnetization measurement in a magnetic field with flux density of 2 Telsa for Example 1 and Comparative Example 1 are shown in FIG. 5. As may be clear from the figure, for Example 1 there are observed a magnetic transition point of $ErAl_2$ in the vicinity of 15K and a magnetic transition point of $DyAl_2$ in the vicinity of 60K. In contrast, for Comparative Example 1, there is observed only one magnetic transition point in the vicinity of 35K for a material that was obtained as a result of mutual diffusion.

Further, the substance of Example 1 was a high density sintered body that has a filling factor that exceeds 95%, and its heat conductivity was 3 W/cm.K which is by one order of magnitude larger than the value of 200 mW/cm.K of Comparative Example 1. Moreover, the abundance ratio of the binder in the sintered body was 20 to 25% by volume.

EXAMPLE 2

An alloy (A) consisting of 75% by weight of Dy, and Al for the remainder, an alloy (B) consisting of 75.6% by weight of Er, and Al for the remainder, an alloy (C) consisting of 37.6% by weight of Dy, 38.2% by weight of Ho, and Al for the remainder, and an alloy (D) consisting of 75.4% by weight of Ho, and Al for the remainder, were prepared separately by the use of the arc fusing furnace. After pulverizing these alloys separately into fine powders with particle diameter of about 30 μm by the ball mill method, powders of alloys (A), (B), (C), and (D) were obtained separately. Then, a mixed powder was obtained by mixing these powders in a mixer in the molar ratio of 1 mol, 0.38 mol, 0.24 mol, and 0.31 mol, respectively.

A sintered body was obtained by applying the treatments similar to those for Example 1 to the mixed powder obtained. Of the sintered body thus obtained, specific heat (Cp) was measured for a state in which there is applied a magnetic field with flux density of 5 Telsa and for the state in the absence of magnetic field, and an examination was made for the sintered body of the temperature dependence of the change in magnetic entropy ($\Delta S_M/R$) whose result is shown in FIG. 6.

Figure 6:
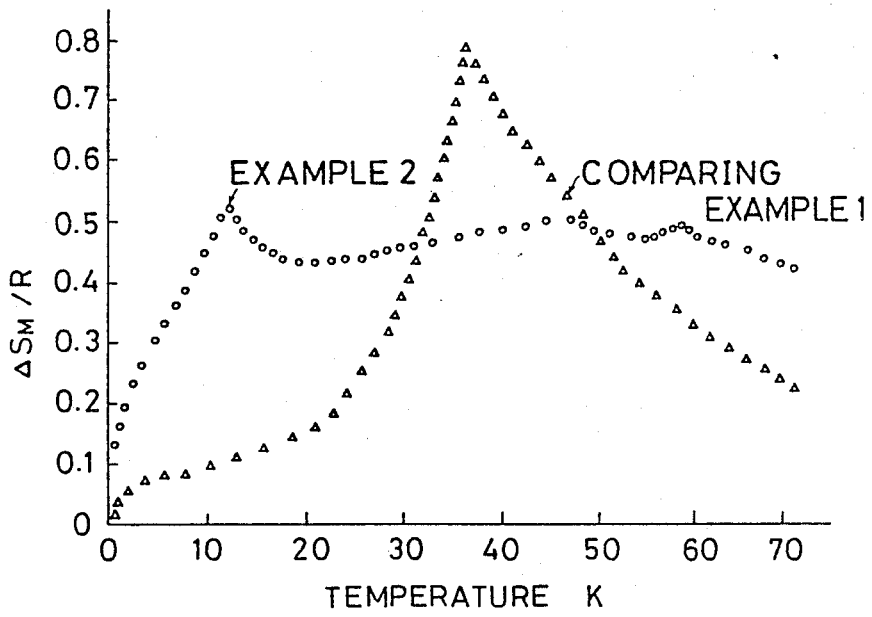
FIG. 6 is a graph for showing the temperature dependence of the change in magnetic entrophy ($\Delta S_M/R$) for Example 2 of the first embodiment shown in FIG. 2 and for Comparative Example 1 shown in FIG. 4.

In addition, the result for the temperature dependence of the change in magnetic entropy for Comparative Example 1 is shown also in FIG. 6.

As may be clear from FIG. 6, the sintered body of the present invention can have the refrigeration effect over a wide temperature range of 10K to 70K, whereas Comparative Example 1 has a narrower range of refrigeration temperature of 30K to 50K.

EXAMPLE 3

A mixed powder was obtained in a manner analogous to the case of Example 1, except for the preparation of an alloy (E) consisting of 58% by weight of Dy, and Ni for the remainder and another alloy (F) consisting of 59% by weight of Er, and Ni for the remainder. A plating treatment analogous to what was given to Example 1 was applied to the mixed powder obtained. In so doing, the ratio in weight of the alloy powder and the amount of copper plated was set to (5 to 6) to 1.

Figure 7:
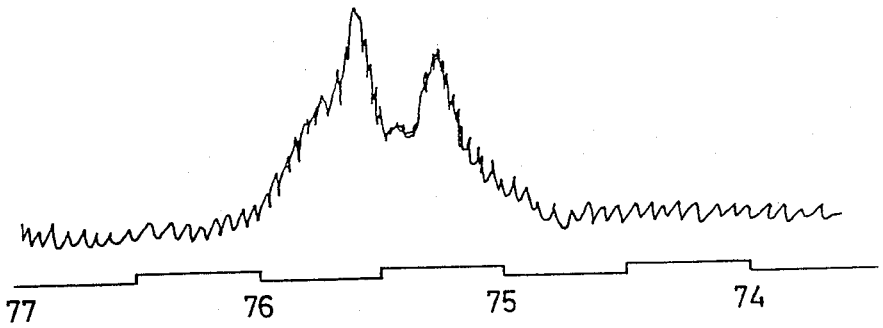
FIG. 7 is a graph for showing the result of X-ray diffraction measurement for Example 3 of the first embodiment shown in FIG. 2.
Figure 8:
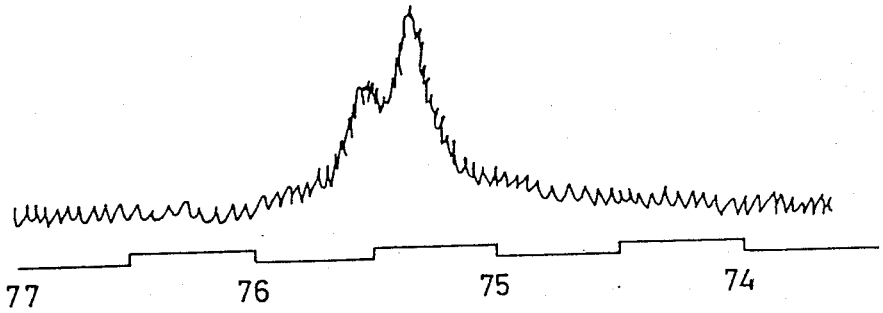
FIG. 8 is a graph for showing the result of X-ray diffraction measurement for Comparative Example 2 obtained by the conventional method of press formation.

Using alloy powders that were given copper plating treatment, a sintered body was obtained analogously to the case of Example 1. The result of X-ray diffraction measurement on the sintered body obtained is shown in FIG. 7. In addition, the result of X-ray diffraction measurement on the sintered body which was manufactured from the same mixed powder in a manner analogous to the case of Comparative Example 1, except for the sintering temperature of 980° C., is shown in FIG. 8 as Comparative Example 2.

Figure 9:
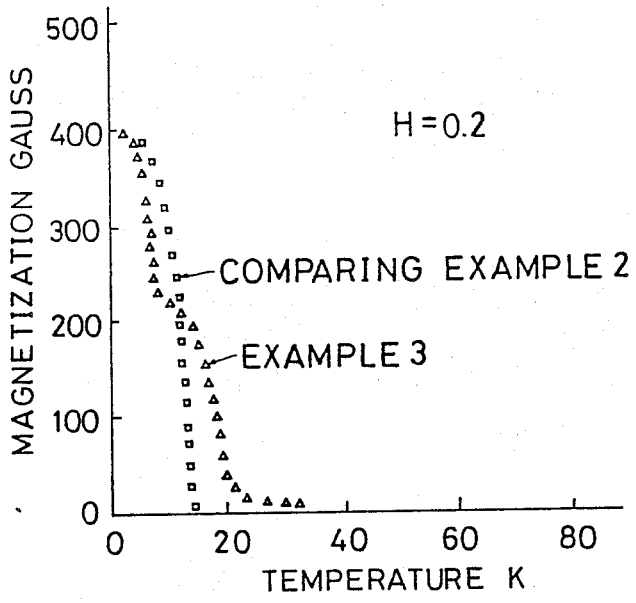
FIG. 9 is a graph for showing the result of magnetization measurement in a magnetic field with a flux density of 0.2 Tesla for Example 3 and Comparative Example 2 shown in FIG. 7 and FIG. 8, respectively.

In addition, the result of magnetization measurements on Example 3 and Comparative Example 2 is shown in FIG. 9. As may be clear from the figure, for Example 3, there are observed a magnetic transition point of $ErNi_2$ in the vicinity of 8K and a magnetic transition point of $DyNi_2$ in the vicinity of 20K.

Further, for Example 3, the filling factor exceeded 98%, and its heat conductivity was 4 W/cm.K which is by one order of magnitude larger that the value of 350 mW/cm.K for Comparative Example 3. Finally, the abundance ratio of the binder in the sintered body was 20 to 25% by volume.

EXAMPLE 4

Alloy powders were obtained analogous to Example 1, except for the preparation of the alloy (E) consisting of 58% by weight of Dy, and Ni for the remainder, an alloy (G) consisting of 58.5% by weight of Ho, and Ni for the remainder, and an alloy (H) consisting of 57.5% by weight of Er, and Ni for the remainder. Then, a mixed powder was obtained by mixing these alloy powders in the molar ratio of 1 mol, 0.4 mol, and 0.3 mol.

By applying treatments analogous to those for Example 3 to the mixed powder produced, there was obtained a sintered body. Using the sintered body thus obtained, specific heat (Cp) was measured for the state in which there was applied a magnetic field with flux density of 5 Telsa and for the state in the absence of magnetic field, and an investigation was made on the temperature dependence of the change in magnetic entropy ($\Delta S_M/R$) which is shown in FIG. 10.

Figure 10:
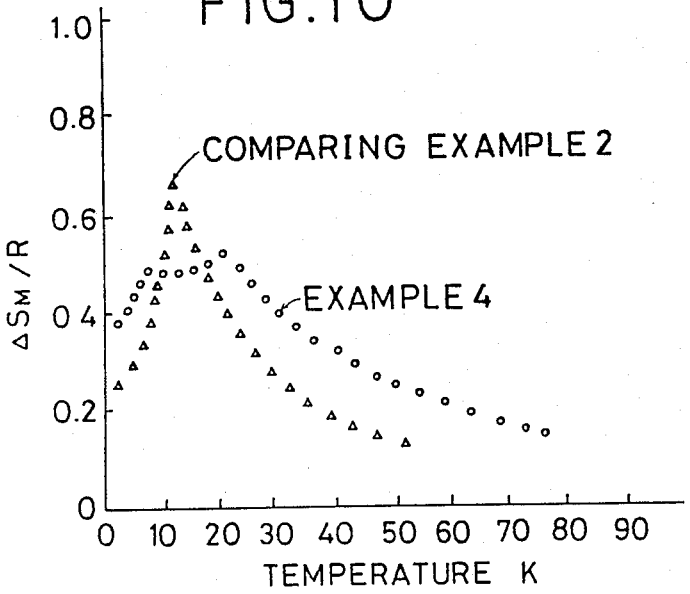
FIG. 10 is a graph for showing the temperature dependence of the change in magnetic entropy ($\Delta S_M/R$) for Example 4 of the first embodiment shown in FIG. 2 and Comparative Example 2 shown in FIG. 8.

In addition, the temperature dependence of the change in magnetic entropy for Comparative Example 2 is also shown in FIG. 10.

EXAMPLE 5

Mixed powders were obtained analogous to Example 1, except for the preparation of an alloy (I) consisting of 58.7% by weight of Er, and Co for the remainder and an alloy (J) consisting of 58.9% by weight of Tm, and Co for the remainder.

To the mixed powders obtained, a plating treatment analogous to Example 1 was applied. The ratio in weight of the alloy powder and the amount of copper plated was (from 4 to 5) to 1.

Figure 11:
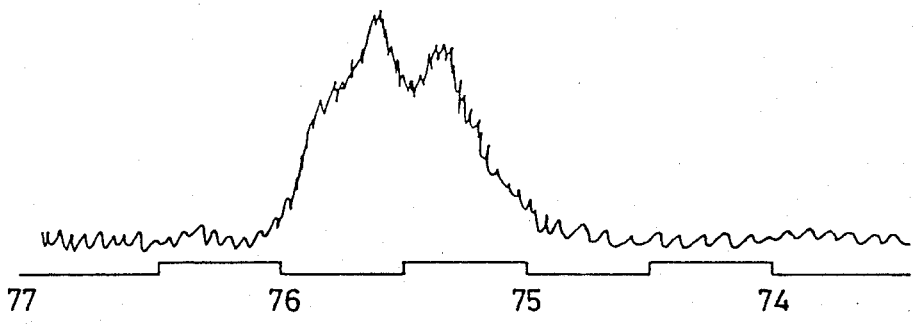
FIG. 11 is a graph for showing the result of X-ray diffraction measurement for Example 5 of the first embodiment shown in FIG. 2.
Figure 12:
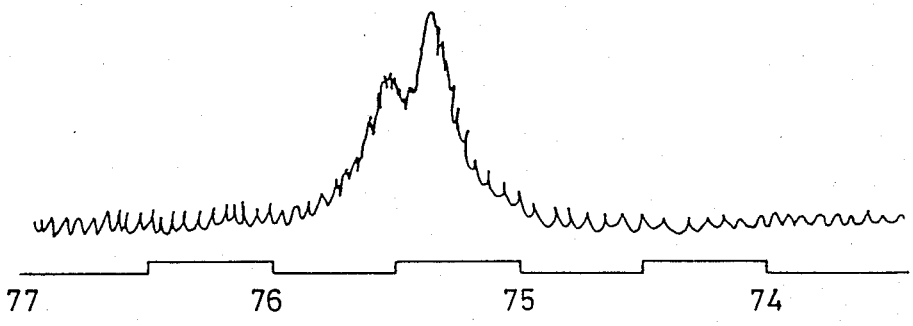
FIG. 12 is a graph for showing the result or X-ray diffraction measurement for Comparative Example 3 obtained by the conventional method of press formation.

A sintered body was obtained from the alloy powder which was treated by copper plating, analogous to Example 1. The result of X-ray diffraction measurement on the sintered body obtained is shown in FIG. 11. In addition, the result of X-ray diffraction measurement on the sintered body which was manufactured from the samed mixed powder in a manner analogous to Example 1, except for the sintering temperature of 1,000° C., is shown in FIG. 12.

Figure 13:
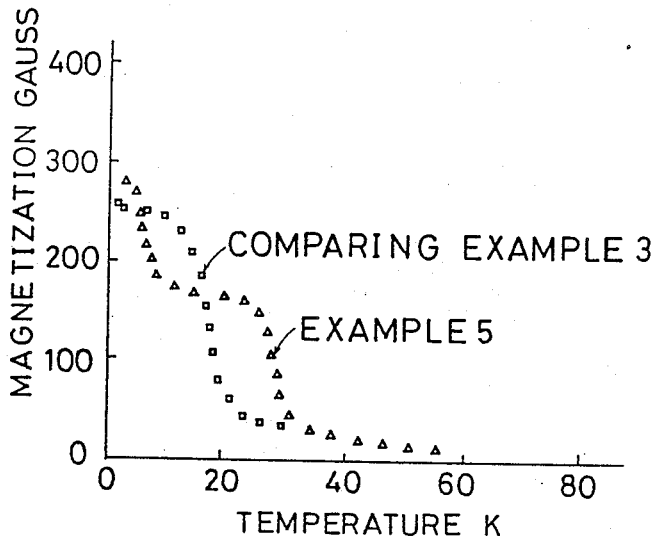
FIG. 13 is a graph for showing the result of magnetization measurement for Example 5 and Comparative Example 3 shown in FIG. 11 and FIG. 12, respectively.

Further, the result of measurements on the magnetization for Example 5 and Comparative Example 3 is shown in FIG. 13. As may be clear from the figure, there are recognized a magnetic transition point of $TmCo_2$ in the vicinity of 10K and a magnetic transition point of $ErCo_2$ in the vicinity of 30K.

Moreover, the filling factor of Example 5 exceeded 98%, and the heat conductivity of Example 5 was 2 W/cm.K which is by one order of magnitude larger than the value of 180 mW/cm.K of Comparative Example 3. In addition, the abundance ratio of the binder in the sintered body was 20 to 25% by volume.

EXAMPLE 6

Alloy powders were obtained analogous to Example 1, except for the preparation of the alloy (I) consisting of 58.7% by weight of Er, and Co for the remainder, the alloy (J) consisting of 58.9% by weight of Tm, and Co for the remainder, and an alloy (K) consisting of 38.9% by weight of Ho, 19.5% by weight of Er, and Co for the remainder. Mixed powders were obtained from the powders of these alloy by mixing them in the molar ratio of 1 mol, 0.5 mol, and 0.7 mol, respectively.

A sintered body was obtained, specific heat (Cp) was measured for a state in which a magnetic field with flux density of 5 Telsa was applied and for the state in which magnetic field was absent. Also, the temperature dependence of the sintered body on the change in magnetic entropy ($\Delta S_M/R$) was investigated, and the result is shown in FIG. 14.

Figure 14:
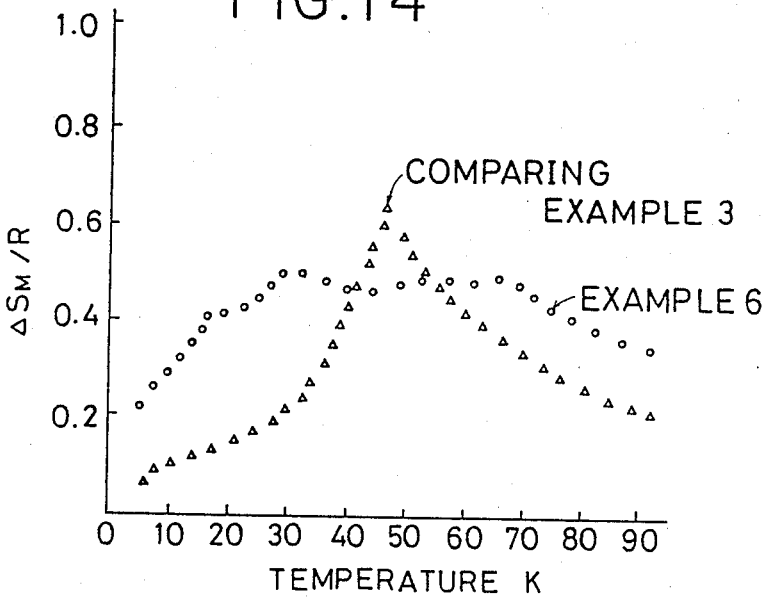
FIG. 14 is a graph for showing the temperature dependence of the change in magnetic entropy ($\Delta S_M/R$) for Example 3 shown in FIG. 12.

In addition, the temperature dependence of the change in magnetic entropy of Comparative Exmple 3 is shown also in FIG. 14.

Next, referring to FIGS. 15 to 19, a second embodiment of the polycrystalline magnetic substance in accordance with the present invention will be described.

The second embodiment was conceived in consideration of the phenomenon that during the sintering of the first embodiment the magneto-caloric effect in the magnetic alloy powder is reduced due to diffusion of the metallic binder into the magnetic alloy powder. The second embodiment is aimed at providing a polycrystalline magnetic substance that is more excellent in magneto-caloric effect at low temperatures and possesses a more excellent heat conduction property, and a method of manufacturing such a substance.

The second embodiment is a polycrystalline magnetic substance which comprises the powders of a magnetic alloy that are formed by at least one kind of rare-earth element (R) selected from Y and the lanthanide elements, and the remainder substantially consisting of at least one kind of magnetic element (M) selected from Ni, Co, and Fe, a covering layer, with high concentration in at least one kind of magnetic element selected from Ni, Co, and Fe, that is formed on the surface of the magnetic alloy powders, and a binder that consists of a nonmagnetic metal that unites the magnetic alloy powders that have the covering layer.

In addition, such a polycrystalline magnetic substance can be obtained by a method of manufacture that comprises a first process of forming a first layer that consists of at least one kind of magnetic element selected from Ni, Co, and Fe, on the surface of the powders of a magnetic alloy that is constructed by at least one kind of rare-earth element selected from Y and the lanthanide elements, and the remainder which consists substantially of at least one kind of element selected from Ni, Co, and Fe; a second process of forming a second layer of nonmagnetic metal that serves as the binder on the first layer; and a third process of compacting the magnetic alloy powders that underwent the second process.

In the polycrystalline magnetic substance in accordance with the second embodiment, the binder that consists of a nonmagnetic metal and the magnetic alloy powder do not come into direct contact, and diffusion of the nonmagnetic metal into the magnetic alloy powder can be prevented, so that it is possible to prevent the reduction in the magnetic characteristics of the magnetic alloy. The diffusion of Fe, Ni, and Co affects the magnetic characteristics to some extent but not to the extent to reduce them.

To describe the second embodiment in more detail, manufacturing of the magnetic alloy powders will be considered first. A magnetic alloy is obtained, for example, by melting $RFe_2$, $RNi_2$, and $RCo_2$ in the arc fusing furnace. Next, alloy obtained is pulverized into fine powders. Since the particle diameter of the powders affects the filling factor, at the time of formation of the mixture, into a forming mold of the mixture that consists of the powders and the binder, that will be described later, it is set to the range of 1 to 100 μm, and preferably to 2 to 30 μm. If the particle diameter exceeds 100 μm, the filling factor is decreased, whereas if it is less than 1 μm, oxidation tends to take place, preventing one from obtaining the desired magneto-caloric effect.

The desirable content of R in the magnetic alloy (when R consists of two kinds of elements, it means the sum of the two contents) is more than 20% by weight and less than 99% by weight. If the content is below the minimum, the magneto-caloric effect becomes inoperative at low temperatures, because $\Delta S_M$ cannot attain large enough value to give a sufficient magneto-caloric effect for all temperatures below the room temperature.

On the other hand, if R exceeds 99% by weight, the content for M is reduced, deteriorating sharply the pulverization property of the alloy. This makes the manufacture of the fine powders difficult, which results in the practical difficulty of forming a compact of the powder. It should be noted that alloy powders that satisfy the above conditions for the contents can become a ferromagnetic alloy powders.

Moreover, in order to obtain a satisfactory magneto-caloric effect, it is desirable to make it indispensable to include at least one kind of element ($R_1$) from the group of Gd, Tb, Dy, Ho, and Er, and it is desirable to set the ratio of $R_1/R$ to a value greater than 50%.

On the surface of the magnetic alloy powders of the above kind there is formed a first layer that consists of the component M (first process). As a method of forming such a layer, it is desirable to employ a plating method such as the electroless plating which enables the formation of a homogeneous thin film, the sputtering method, or a vapor phase growth method such as the vapor deposition method. When using the plating method, it is desirable to give pre-treatments such as degreasing, activation, and washing. The first layer prevents, in the forming process in a later process, diffusion of the binder into the magnetic alloy powders which reduces the magnetic property of the product. The first layer is desired to have a thickness of greater than 0.05 μm. If it is too thin, the effect of preventing the diffusion of the binder tends to be difficult to attain. On the other hand, it will be sufficient if it can prevent the binder diffusion. The presence of a layer which is beyond what is sufficient reduces the amount of the magnetic alloy powders, when seen as a polycrystalline body, so that it is set smaller than 1 μm in practice.

Following the above, a second layer that consists of magnetic metals, which serves as the binder, is formed (second process). The method of forming the layer is similar to the first layer. For the binder, a high heat conductivity is required, with a preferred value of greater than 1 W/cm.K at 4.2K, and the use, for example, of Au, or Cu can be mentioned as the candidate. The preferred thickness of the second layer is 0.05 to 1 μm.

The binder has, in the compacted form that can be obtained by the method that will be described later, the function of enhancing the heat conduction property, as well as the function of binding the various kinds of mixed powders under the condition in which they are separated mutually independent. As a result, making it possible to obtain a sintered body that possesses a plurality of magnetic transition points.

Then, the magnetic alloy powders that underwent the second process were formed into a compact (second process). For example, it is possible to obtain a desired compact by a method of sintering after press forming or by the impact pressure forming method.

In the case of employing the sintering method, the pressure of pressing is set to 500 to 10,000 kg/cm$^2$, and preferably to 1,000 to 10,000 kg/cm$^2$. Next, the compact thus obtained was given a sintering treatment in a nonoxidizing atmosphere. As such a nonoxidizing atmosphere, a vacuum of less than the pressure of $10^{-6}$ Torr or an inert gas such as Ar and $N_2$ may be mentioned.

The sintering temperature was 100° to 1,200° C. If the sintering temperature is less than 100° C., high filling factor cannot be obtained. On the other hand, if it exceeds 1,200° C., mutual diffusion proceeds between the binder metal and the alloy powders, so that a sufficient refrigeration effect cannot be obtained over a wide range of temperature.

In the case of employing the impact pressure forming method a high density compact can be obtained by filling the metal-covered magnetic alloy powders in a capsule, and by forming a compact by impact pressuring. For example, impact pressuring at 1 million to 10 million atm. press. by rail gun, impact pressuring by rifle gun, explosive forming by the use of gun powder, and other method are effective. In addition, high pressure formation by pressing under an ultra high pressure of 100,000 atm. press. will also by effective.

Figure 15:
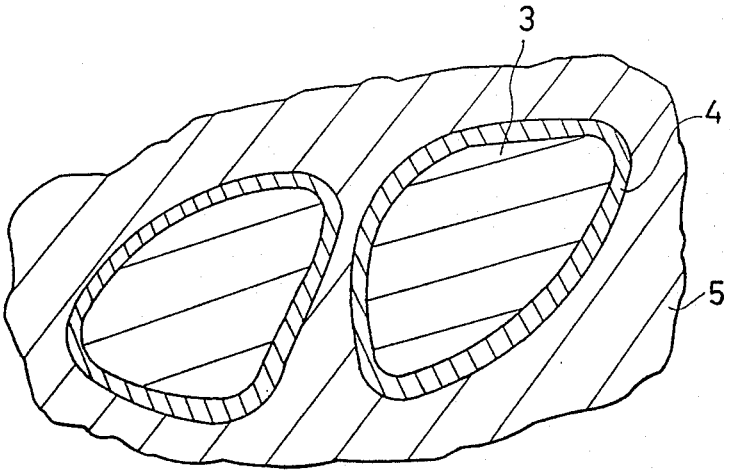
FIG. 15 is a schematic block diagram of a second embodiment of the polycrystalline magnetic magnetic substance in accordance with the present invention.

In a polycrystalline magnetic substance obtained in the above manner, the M component in the first layer diffuses into the magnetic alloy powders. Accordingly, there occurs sometimes a case in which a covering layer that consists solely of the M component exists on the surface of the magnetic alloy powders, or a case the entire first layer is replaced by a diffusion layer. In either case, the concentration of the M component on the surface of the magnetic alloy powders is higher than that in the interior of the powders (covering layer). Then, as shown in FIG. 15, magnetic alloy powders 3 that have the covering layers 4 are bound by the binder 5. The abundance ratio of the binder in the polycrystalline substance is 1 to 80% by volume, and preferably 5 to 30% by volume. If the abundance ratio is less than 1% by volume, compacting is difficult due to small binding ability of the binder, and at the same time, mutual diffusion proceeds during the sintering between the alloy powders so that it becomes difficult to achieve the object. On the other hand, if it exceeds 80% by volume, the ratio of the magnetic alloy powders is decreased and the magneto-caloric effect per unit volume is reduced, and in addition, there occurs a heating, during the control of the magnetic field, due to eddy current loss, so that the refrigeration effect is lowered sharply.

In addition, when there is one kind of magnetic alloy powders, there can be obtained an excellent heat conduction property. When formation is carried out by preparing two kinds or more of magnetic alloy powders, a mixed polycrystalline magnetic substance that possesses a plurality of separate magnetic transition points can also be obtained. When two kinds or more of magnetic alloy powders with different elements for R are used, the metals in the remainder of the respective magnetic alloy powders may be either of the same kind or of different kinds. Accordingly, powders to be prepared will be, for example, a combination of $DyNi_2$, $ErNi_2$, and $DyHoNi_2$ or a combination of $DyNi_2$ and $DyCo_2$. By mixing and compacting by preparing two kinds or more of magnetic alloy powders, it becomes possible to obtain a polycrystalline magnetic substance that possesses more than two magnetic transition points. Therefore, it becomes possible to obtain the magnetocaloric effect over a wide range of temperature.

EXAMPLE 1

Figure 16:
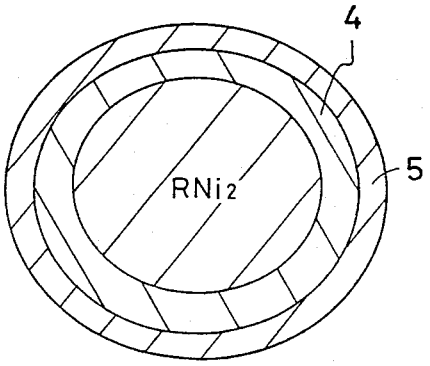
FIG. 16 is a schematic block diagram for Example 1 of the second embodiment shown in FIG. 15.

An alloy consisting of 58% by weight of Dy, and Ni for the remainder was prepared by the use of the arc fusing furnace, and the alloy was pulverized by ball mill method into fine powders with particle diameter of about 6 μm. After giving degreasing (1,1,1-trichloroethane), activation (activation solution with pH of 10 to 11), and washing (EcoH) to the fine powders obtained, and carrying out electroless plating using electroless gold (Atomex Au made by Japan Engelhardt Company) under the conditions of pH of 4 to 10, temperature of 90° C., with strong stirring, powders were made that are covered with Ni in the inner portion 4 and with Au in the outer portion 5, as shown in FIG. 16. The powders were further washed (EroH) and then dried. ith the above plating treatment, there were formed a covering film of Ni of 0.5 μm thickness (first layer) and a covering film of Au of 0.5 μm thickness (second layer) on the surface of the alloy powders.

After the above alloy powders that received Ni and Au plating were compacted by pressing under a pressure of 10 t/cm$^2$, it was sintered in an atmosphere of Ar gas. From the result of an X-ray diffraction experiment on the sintered body thus obtained, there are recognized diffraction peaks corresponding to Au, Ni-Au, $DyNi_2$, and $DyNi_3$. In addition, after SEM-EDX on the sintered body obtained and a spectral analysis, it was confirmed that the composition was being modulated with a period close to the initial particle diameter of 6 μm.

Figure 17:
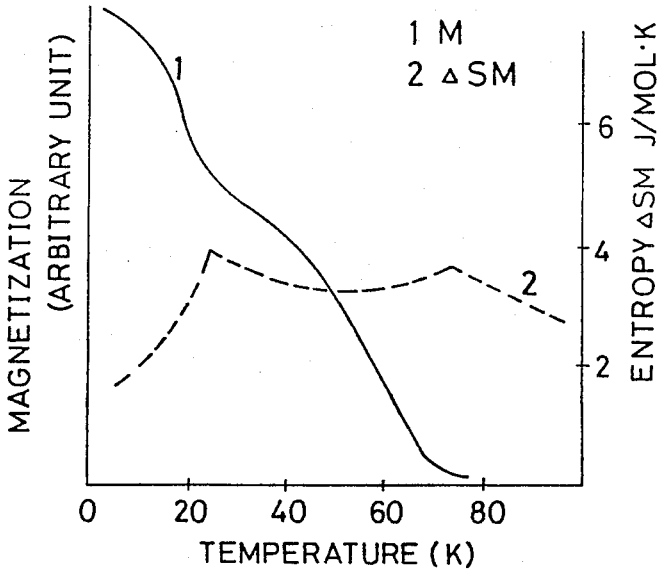
FIG. 17 is a graph for showing the temperature dependences of the magnetization and the change in magnetic entropy ($\Delta S_M$) for Example 1 shown in FIG. 16.

Further, specific heat (Cp) of Example 1 was measured for a state in which there was applied a magnetic field with flux density of 5 Tesla and for the state in the absence of magnetic field, and the result of magnetization measurement of Example 1 in a magnetic field with flux density of 2 Tesla and the result of the investigation of its temperature dependence of the change in magnetic entropy ($\Delta S_M$) are shown in FIG. 17. As may be clear from the figure, there were observed a magnetic transistion point of $DyNi_2$ in the vicinity of 20K and a magnetic transition point of $DyNi_3$ in the vicinity of 70K. In addition, Example 1 was a high density sintered body with a filling factor that exceeded 95%, and its heat conductivity was 3 W/cm.K which is by one order of magnitude larger than 302 mW/cm.K of $DyNi_2$. Further the abundance rate of Au in the sintered body was 25% by volume.

EXAMPLE 2

Figure 18:
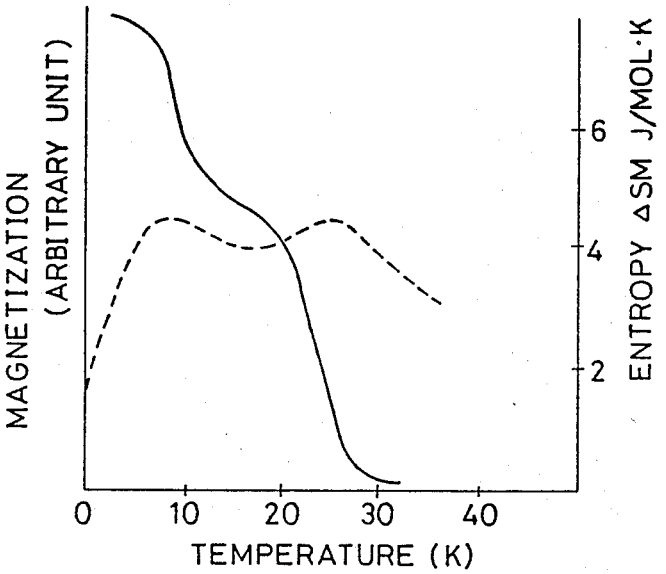
FIG. 18 is a graph for showing the temperature dependences of the magnetization and the change in magnetic entropy ($\Delta S_M$) for Example 2 fo the second embodiment shown in FIG. 15.

An alloy (A) consisting of 58% by weight of Dy, and Ni for the remainder, and an alloy (B) consisting of 59% by weight of Er, and Ni for the remainder were prepared separately by using the arc fusing furnace. After pulverizing the alloys separately into fine powders with particle diameter of about 6 μm by ball mill method, powders of alloy (A) and powders of alloy (B) thus obtained were mixed with equal molar ratio in the mixer, to obtain mixed powders. A sintered body was obtained by giving treatments analogous to Example 1 to the mixed powders obtained. Using the sintered body thus obtained, specific heat (Cp) was measured for a state in which there was applied a magnetic field with flux density of 5 Tesla and for the state in the absence of magnetic field. The result of magnetization measurement in a magnetic field with flux density of 2 Tesla and the result of investigation of the temperature dependance of the change in magnetic entropy ($\Delta S_M$) are shown in FIG. 18. As may be clear from the figure, there were observed a magnetic transition point of $ErNi_2$ in the vicinity of 5K and a magnetic transition point of $DyNi_2$ in the vicinity of 25K.

Figure 19:
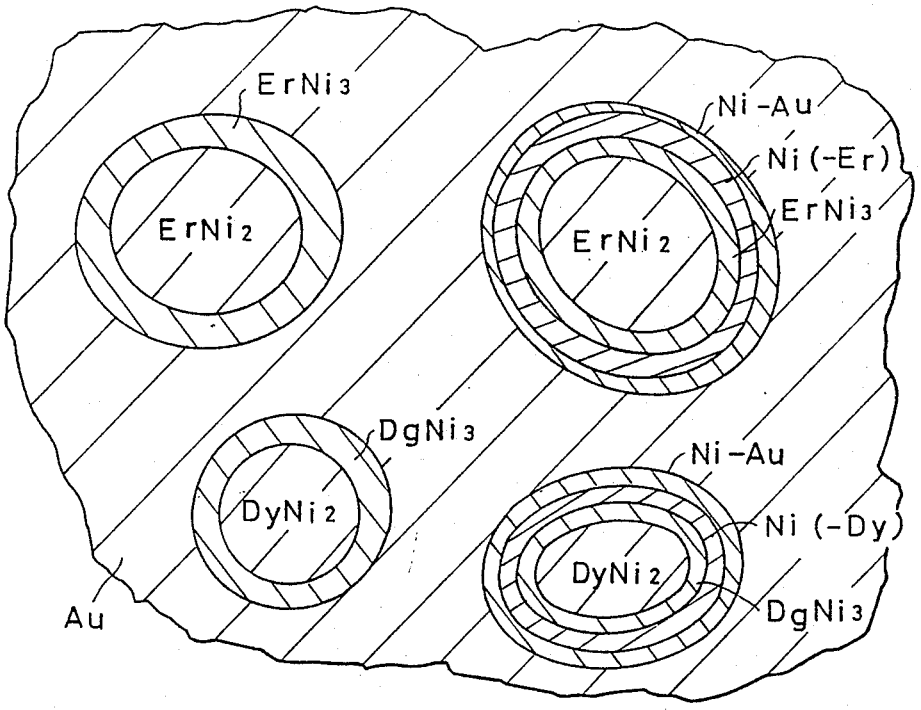
FIG. 19 is a schematic block diagram for Example 3 of the second embodiment shown in FIG. 15.

Further, as a result of X-ray diffraction measurement of Example 2, in addition to the peaks for Au, Ni-Au, $DyNi_2$, and $ErNi_2$, there was confirmed the presence of the diffraction peaks for the covering layers $DyNi_3$ and $ErNi_3$. Namely, the composition form of Example 2 consists of the covering layers $ErNi_3+Ni(-Er)-+Ni-Au$ and $DyNi_3+Ni(-Dy)+Ni-Au$, with $DyNi_2$ and $ErNi_2$ existing independently in the Au layer, as shown in FIG. 19. This is considered due to suppression by the covering layers of the diffusion of Au into $RNi_2$.

Next, referring to FIGS. 20 to 23, a third embodiment of the polycrystalline magnetic substance in accordance with the present invention will be described.

According to the method of the present invention, two kinds or more of magnetic alloy are prepared first by the use of, for example, the arc fusing furnace. These magnetic alloys have different magnetic transition points, crystal phase transformation points, transformation points due to Jahn-Teller effect, or spin rearrangement temperatures, and consist of rare-earth-(Group III metal), rare-earth-(Group IV metal), rare-earth-(Group Ia metal), rare-earth-(Group IIa metal), and rare-earth-(Group 4*d* or 5*d* transition metal). Next, these magnetic alloys are pulverized separately, for example, by ball mill, to obtain fine powders of magnetic alloys. The particle diameter of the magnetic alloy fine powders is set to 0.1 to 1,000 μm (for the reasons described above), and preferably 1 to 100 μm. Then, the fine powders of each magnetic alloy are mixed, and the mixture is precompacted if needed. Next, the mixed powders or its pre-compact is surrounded with a ductile material and housed in a closed container via a pressure medium. After tightly comparting with explosive compression of the mixed powder or its pre-compact under explosion of explosives at high speed, a mixed polycrystalline magnetic substance is manufactured by obtaining a compact through removal of the ductile member. After impact pressure forming of this kind, it is desirable to give a heat treatment to the compact at 100 to 1,000° C.

EXAMPLE 1

First, an alloy (A) consisting of 58.5% by weight of Er, and Ni for the remainder, an alloy (B) consisting of 58.2% by weight of Ho, and Ni for the remainder, and an alloy (C) consisting of 57.9% by weight of Dy, and Ni for the remainder, were prepared separately by using the arc fusing furnace. The Curie point for each of these single alloys were 8K for (A), 15K for (B), and 22K for (C). Next, using a jet mill, each of these alloys was pulverized into fine powders with particle diameter of about 3μm. Then, a mixed powder was obtained by mixing each of the fine powders thus obtained for about 5 hours in an argon atmosphere in a mixer. Here, the ratio in weight of each of the fine powders of alloys (A), (B), and (C) was 3:1:4. The mixed powder obtained was filled in a cylindrical container made of soft steel, and after pre-compacting it under a pressure of 1 t/cm$^2$, the container was vacuum sealed. Setting the vacuum sealed cylinder in gun powder, and generating explosive shock waves by igniting the gun powder from the upper part of the cylinder, impact pressure forming was carried out. The speed of the shock wave during the formation was 5,000 m/sec.

The dimensions of the compact obtained were a diameter of 15 mm and a length of 30 mm. Further, with the theoretical density 100, the filling factor of the compact had a high density of 99.9%. Moreover, its heat conductivity was as large as 500 mW/cm.K.

Figure 20:
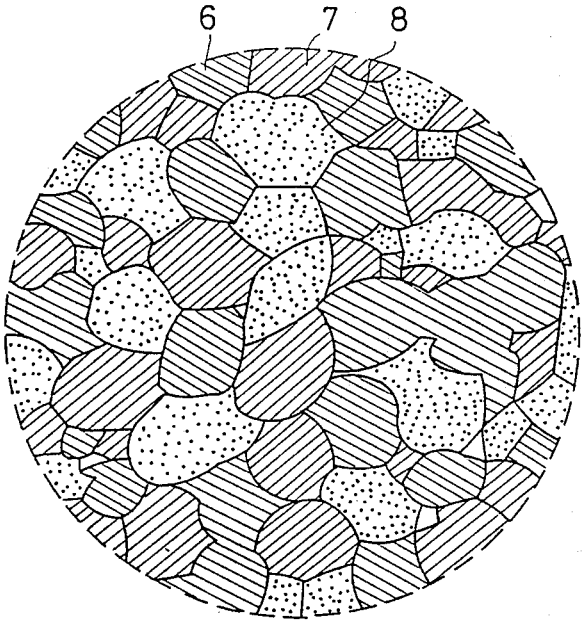
FIG. 20 is a schematic diagram for showing the surface condition, by the SEM observation, of a third embodiment of the polycrystalline magnetic substance of the present invention.

First, the result of the SEM-EDX element ahalysis of the compact obtained is shown schematically in FIG. 20. It was observed that each of the crystal particles was tightly compacted by maintaining the particle diameter (mean value of 3 μm) of the initial fine powder. In addition, it was seen that the compact was a mixed polycrystalline substance which is a mixture of the fine crystalline particles 6 of alloy (A), fine crystalline particles 7 of alloy (B), and fine crystalline particles 8 of alloy (C), under a condition in which each of the crystalline particles several μm in size is homogeneously mixed as a unit.

Figure 21:
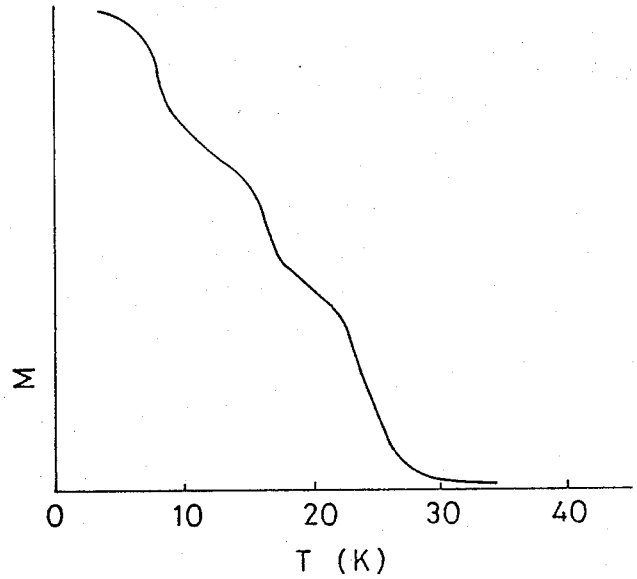
FIG. 21 is a graph for showing the temperature dependence of the magnetization in a magnetic field with flux density of 2 Tesla for the third embodiment shown in FIG. 20.
Figure 22:
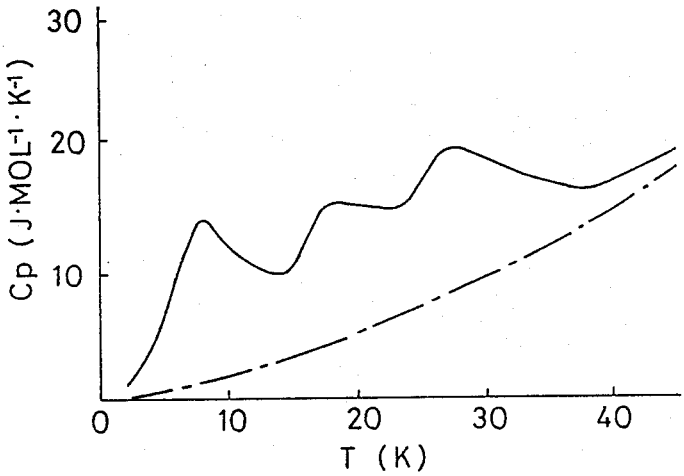
FIG. 22 is a graph for showing the temperature dependence of the specific heat in the absence of magnetic field for the third embodiment shown in FIG. 22.
Figure 23:
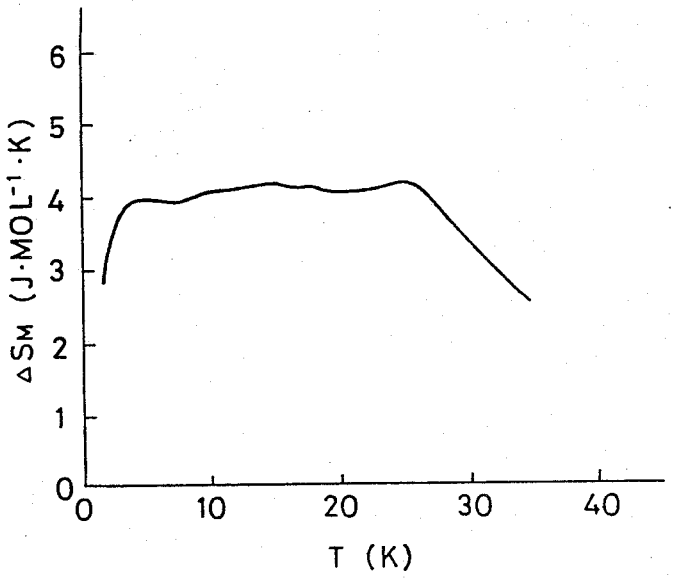
FIG. 23 is a graph for showing the temperature dependence of the change in magnetic entropy ($\Delta S_M$) for the third embodiment shown in FIG. 23.

Next, the results of the various kinds of measurement taken of the mixed polycrystalline magnetic substance are shown in FIGS. 21 to 23. In FIG. 21 is shown the result of the investigation of the temperature dependence of magnetization in the presence of a magnetic field with flux density of 2 Tesla. In FIG. 22 is shown the result of examination on the temperature dependence of the specific heat (Cp) in the absence of magnetic field. In FIG. 23 is shown the result of determination of the temperature dependence of the change in magnetic entropy ($\Delta S_M$) obtained by computation based on the temperature dependence of the specific heat ($C_p$) measured for a state in which a magnetic field with flux density of 5 Tesla is applied and for the state in the absence of magnetic field.

As may be clear from FIG. 21, in the mixed polycrystalline magnetic substance, the temperature range for which a significant magnetization can be obtained is wide, extending up to 28K, with a decrease in magnetization for increase in the temperature, having two observable flection points in the curve.

Further, as may be clear from FIG. 22, the present polycrystalline magnetic substance shows three peaks at 8K, 18K, and 27K in the curve for the specific heat.

Moreover, as may be clear from FIG. 23, for the present polycrystalline magnetic substance, the curve for the entropy change is approximately constant over a relatively wide range of 3K to 28K.

In summary, according to the present invention, it is possible to provide a mixed polycrystalline magnetic substance, and a method for conveniently manufacturing such a mixed polycrystalline magnetic substance, which shows a high magneto-caloric effect over a wide temperature range in the low temperature region below 77K. Therefore, it is possible to obtain an excellent performance as the magnetic substance for a magnetic refrigerating machine due to Ericson cycle, and as a cold storage material for a gas refrigerating machine due to Stirling cycle or Gifford Mcmahon cycle (GM cycle), etc.

What is claimed is:

1. A magnetic refrigerant comprised of a polycrystalline magnetic substance comprising a plurality of magnetic alloy fine crystalline particles that comprise at least one rare-earth element selected from the group of Y, La, Ce, Pr, Nd, Pm, Sm, Eu, Gd, Tb, Dy, Ho, Er, Tm, and Yb, and the remainder comprising at least one metal selected from the group consisting of Al, Ni, Co, and Fe; and a metallic binder for forming a compact together with said fine crystalline particles, the abundance ratio of said metallic binder in the compact being 1 to 80% by volume.

2. The magnetic refrigerant as claimed in claim 1, wherein said magnetic alloy fine crystalline particles comprise two kinds or more of alloy fine crystalline particles.

3. The magnetic refrigerant as claimed in claim 1, wherein said metallic binder comprises at least one of a metal and an alloy having a heat conductivity at 4.2K of 1 W/cm.K or over.

4. The magnetic refrigerant as claimed in claim 1, wherein said metallic binder comprises a covering layer formed on said magnetic alloy fine crystalline particles and a nonmagnetic metal for connecting the magnetic alloys covered with the covering layer, wherein said covering layer is comprised of at least one kind of magnetic element selected from the group consisting of Ni, Co, and Fe, which is at a higher concentration than that in the magnetic alloys.

5. The magnetic refrigerant as claimed in claim 4, wherein rare-earth elements are mixed in the magnetic alloys at the ratio of 20% by weight to 99% by weight.

6. The magnetic refrigerant as claimed in claim 4, wherein the nonmagnetic metal comprises a metal or an alloy with a heat conductivity of 1 W/cm.K or over at 4.2K.

7. The magnetic refrigerant as claimed in claim 4, wherein the nonmagnetic metal is at least one kind of element selected from Au, Ag, and Cu.

8. The magnetic refrigerant as claimed in claim 4, wherein the covering layer comprises at least one kind of magnetic element selected from Ni, Co, and Fe.

9. The magnetic refrigerant as claimed in claim 4, wherein said magnetic alloy fine crystalline particles comprise two kinds or more of fine crystalline particles.

10. The magnetic refrigerant as claimed in claim 4, wherein the particle diameter of said magnetic alloy fine crystalline particles is 1 to 100 μm.

11. A magnetic refrigerant as claimed in claim 1, wherein the plurality of particles is comprised of at least two kinds of magnetic alloy fine crystalline particles having different magnetic transition points, crystal phase transformation points, transformation points due to Jahn-Teller effect, or spin rearrangement temperatures.

12. A magnetic refrigerant comprising at least two kinds of magnetic alloy fine crystalline particles having different magnetic transition points, crystal phase transformation points, transformation points due to Jahn-Teller effect, or spin rearrangement temperatures, wherein each of said two kinds of particles comprises at least one element selected from the group consisting of Y, La, Ce, Pr, Nd, Pm, Sm, Eu, Gd, Dy, Tb, Ho, Er, Tm, and Yb, and at least one element selected from B, Al, Ga, In, Tl, Si, Ge, Sn Pb, Cu, Ag, Au, Be, Mg, Zn, Cd, Hg, Ru, Rb, Pd, Os, Ir, Pt, Fe, Co, and Ni.

13. The magnetic refrigerant as claimed in claim 11, wherein the filling factor of the magnetic alloy fine crystalline particles in the compact is 95% or more.

14. The magnetic refrigerant as claimed in claim 11, wherein the particle diameter of said magnetic alloy fine crystalline particles is 0.1 to 1,000μm.

15. The magnetic refrigerant as claimed in claim 2, wherein the two kinds of particles have different magnetic transition points, crystal phase transformation points, transformation points due to Jahn-Teller effect, or spin rearrangement temperatures.

16. The magnetic refrigerant as claimed in claim 5, wherein said plurality of particles is comprised of at least two kinds of magnetic alloy fine crystalline particles.

17. The magnetic refrigerant as claimed in claim 15, wherein the particle diameter of said fine crystalline particles is 1 to 100μm.

18. A magnetic refrigerant composed of polycrystalline magnetic substance comprising a plurality of magnetic alloy fine crystalline particles that comprise at least one rare-earth element selected from the group of Y, La, Ce, Pr, Nd, Pm, Sm, Eu, Gd, Tb, Dy, Ho, Er, Tm, and Yb, and the remainder comprising at least one metal selected from the group consisting of Al, Ni, Co, and Fe; and a metallic binder for forming a compact together with said fine crystalline particles, the abundance ratio of said metallic binder in the compact being 1 to 80% by volume, wherein said polycrystalline magnetic substance is in a weakly magnetized state between about 40° and 70° K.

19. A magnetic refrigerant composed of polycrystalline magnetic substance comprising a plurality of magnetic alloy fine crystalline particles that comprise at least one rare-earth element selected from the group of Y, La, Ce, Pr, Nd, Pm, Sm, Eu, Gd, Tb, Dy, Ho, Dr, Tm, and Yb, and the remainder comprising at least one metal selected from the group consisting of Al, Ni, Co, and Fe; and a metallic binder for forming a compact together with said fine crystalline particles, the abundance ratio of said metallic binder in the compact being 1 to 80% by volume wherein said polycrystalline magnetic substance undergoes a steep decline in magnetization in the range of about 8° K. and 80° K.

20. The magnetic refrigerant as claimed in claim 1, wherein the remainder comprises at least one metal selected from the group consisting of Al and Ni only.

21. The magnetic refrigerant as claimed in claim 12, wherein each of said two kinds of particles comprises at least one element selected from the group consisting of Y, La, Ce, Pr, Nd, Pm, Sm, Eu, Gd, Dy, Tb, Ho, Er, Tm and Yb and at least one element selected from B, Al, Ga, In, Tl, Si, Ge, Sn, Pb, Cu, Ag, Au, Be, Mg, Zn, Cd, Hg, Ru, Rb, Pd, Os, Ir, Pt, and Ni.

22. The magnetic refrigerant as claimed in claim 18, wherein said polycrystalline magnetic substance is in a weakly magnetic state at room temperature.

* * * * *